US010526864B2

(12) United States Patent
Deng et al.

(10) Patent No.: US 10,526,864 B2
(45) Date of Patent: Jan. 7, 2020

(54) SEAL BACKUP, SEAL SYSTEM AND WELLBORE SYSTEM

(71) Applicants: Guijun Deng, The Woodlands, TX (US); Alexander M. Kendall, Houston, TX (US); Andrew J. Cayson, Cypress, TX (US)

(72) Inventors: Guijun Deng, The Woodlands, TX (US); Alexander M. Kendall, Houston, TX (US); Andrew J. Cayson, Cypress, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 16/149,815

(22) Filed: Oct. 2, 2018

(65) Prior Publication Data

US 2019/0040710 A1 Feb. 7, 2019

Related U.S. Application Data

(63) Continuation-in-part of application No. 15/486,621, filed on Apr. 13, 2017, now abandoned.

(51) Int. Cl.
*E21B 33/12* (2006.01)
*E21B 33/128* (2006.01)

(52) U.S. Cl.
CPC ..... *E21B 33/1216* (2013.01); *E21B 33/128* (2013.01)

(58) Field of Classification Search
CPC ..... E21B 33/1293; E21B 33/1216; E21B 33/128; E21B 33/126
See application file for complete search history.

(56) References Cited

U.S. PATENT DOCUMENTS 2,726,722 A 12/1955 Baker
2,767,795 A 10/1956 Bush
2,797,759 A 7/1957 Long et al.
2,885,009 A 5/1959 Baker
(Continued)

FOREIGN PATENT DOCUMENTS

AU 2015397127 B2 12/2016
EP 1197632 A2 4/2002
(Continued)

OTHER PUBLICATIONS

Notification of Transmittal of the International Search Report and the Written Opinion of the International Searching Authority, or the Declaration; PCT/US2018/027359; dated Aug. 1, 2018; 11 pages.
(Continued)

*Primary Examiner* — Giovanna C Wright
*Assistant Examiner* — Brandon M Duck
(74) *Attorney, Agent, or Firm* — Cantor Colburn LLP

(57) ABSTRACT

A seal backup including: a ring-like body, the body including: a first portion of the body having a first generally zig-zag construction, the first generally zig-zag construction facilitative of radial expansion of the first portion; a second portion of the body having a second generally zig-zag construction, the second generally zig-zag construction facilitative of radial expansion of the second portion; a parting feature disposed between the first portion of the body and the second portion of the body facilitative of relative movement between the first portion of the body and the second portion of the body.

19 Claims, 10 Drawing Sheets

(56) References Cited

U.S. PATENT DOCUMENTS

| | | | |
|---|---|---|---|
| 2,921,633 | A | 1/1960 | Baker |
| 2,945,541 | A | 7/1960 | Maly et al. |
| 3,229,767 | A | 1/1966 | Carter |
| 3,298,440 | A | 1/1967 | Current |
| 3,313,553 | A | 4/1967 | Gastineau |
| 3,343,607 | A | 9/1967 | Current |
| 3,358,766 | A | 12/1967 | Current |
| 3,381,969 | A | 5/1968 | Crow et al. |
| 3,385,679 | A | 5/1968 | Current |
| 3,481,611 | A | 12/1969 | Stratton |
| 3,960,311 | A | 6/1976 | Griffiths |
| 4,204,690 | A | 5/1980 | Holland et al. |
| 4,349,204 | A | 9/1982 | Malone |
| RE31,933 | E | 7/1985 | Taylor et al. |
| 4,665,978 | A | 5/1987 | Luke |
| 4,753,444 | A | 6/1988 | Jackson et al. |
| 4,765,404 | A | 8/1988 | Bailey et al. |
| 4,852,394 | A | 8/1989 | Lazes |
| 4,892,144 | A | 1/1990 | Coone |
| 4,910,832 | A | 3/1990 | Schaub et al. |
| 5,027,894 | A | 7/1991 | Coone et al. |
| 5,161,806 | A | 11/1992 | Balsells |
| 5,311,938 | A | 5/1994 | Hendrickson et al. |
| 6,318,482 | B1 | 11/2001 | Fidtje |
| 6,431,274 | B1 | 7/2002 | Tedham et al. |
| 6,513,600 | B2 | 2/2003 | Ross |
| 6,581,682 | B1 | 6/2003 | Parent et al. |
| 6,598,672 | B2 | 7/2003 | Bell et al. |
| 7,124,826 | B2 | 10/2006 | Simpson |
| 7,178,601 | B2 | 2/2007 | Burge |
| 7,273,110 | B2 | 9/2007 | Pedersen et al. |
| 7,306,034 | B2 | 12/2007 | Garcia |
| 7,341,110 | B2 | 3/2008 | Doane et al. |
| 7,665,516 | B2 | 2/2010 | Roberts et al. |
| 7,708,080 | B2 | 5/2010 | Conaway et al. |
| 8,151,873 | B1 | 4/2012 | Lee et al. |
| 8,151,894 | B2 | 4/2012 | Nutley et al. |
| 8,205,671 | B1 | 6/2012 | Branton |
| 8,276,678 | B2 | 10/2012 | Burnett et al. |
| 8,327,929 | B2 | 12/2012 | Reid et al. |
| 8,469,088 | B2 | 6/2013 | Shkurti et al. |
| 8,479,809 | B2 | 7/2013 | Farquhar |
| 8,662,161 | B2 | 3/2014 | Lee et al. |
| 8,701,787 | B2 | 4/2014 | Shkurti et al. |
| 8,839,874 | B2 | 9/2014 | Bishop et al. |
| 9,140,094 | B2 | 9/2015 | Lee et al. |
| 9,587,458 | B2 | 3/2017 | Derby |
| 2002/0043368 | A1 | 4/2002 | Bell et al. |
| 2003/0037932 | A1 | 3/2003 | Guillory et al. |
| 2003/0226659 | A1 | 12/2003 | Smith et al. |
| 2004/0134659 | A1 | 7/2004 | Hoffman et al. |
| 2006/0289173 | A1 | 12/2006 | Conaway et al. |
| 2007/0125532 | A1 | 6/2007 | Murray et al. |
| 2007/0200299 | A1 | 8/2007 | Kunz |
| 2007/0256827 | A1 | 11/2007 | Guerrero et al. |
| 2007/0261863 | A1 | 11/2007 | MacLeod et al. |
| 2008/0041583 | A1 | 2/2008 | Angman et al. |
| 2008/0061510 | A1 | 3/2008 | Li et al. |
| 2008/0073074 | A1 | 3/2008 | Frazier |
| 2008/0190600 | A1 | 8/2008 | Shkurti et al. |
| 2009/0065191 | A1 | 3/2009 | Reid et al. |
| 2009/0159265 | A1 | 6/2009 | Freyer |
| 2009/0255690 | A1 | 10/2009 | Conner et al. |
| 2009/0308592 | A1 | 12/2009 | Mercer et al. |
| 2010/0038074 | A1 | 2/2010 | Patel |
| 2010/0186970 | A1 | 7/2010 | Burnett |
| 2010/0276137 | A1 | 11/2010 | Nutley et al. |
| 2010/0294485 | A1 | 11/2010 | Lynde et al. |
| 2011/0101615 | A1 | 5/2011 | Clarke et al. |
| 2011/0297368 | A1 | 12/2011 | Lembcke |
| 2012/0018143 | A1 | 1/2012 | Lembcke |
| 2012/0037355 | A1 | 2/2012 | Bishop et al. |
| 2012/0073830 | A1 | 3/2012 | Lembcke et al. |
| 2012/0133098 | A1 | 5/2012 | Farquhar |
| 2012/0217025 | A1 | 8/2012 | Shkurti et al. |
| 2012/0305236 | A1 | 12/2012 | Gouthaman |
| 2013/0147120 | A1 | 6/2013 | O'Malley |
| 2013/0213672 | A1 | 8/2013 | Nutley et al. |
| 2013/0306330 | A1 | 11/2013 | Bishop et al. |
| 2013/0306331 | A1 | 11/2013 | Bishop et al. |
| 2014/0034335 | A1 | 2/2014 | Nutley et al. |
| 2014/0262351 | A1 | 9/2014 | Derby |
| 2014/0290946 | A1 | 10/2014 | Nguyen et al. |
| 2015/0308214 | A1 | 10/2015 | Bilansky et al. |
| 2015/0354313 | A1 | 12/2015 | McClinton et al. |
| 2016/0369586 | A1 | 12/2016 | Morehead et al. |
| 2017/0191340 | A1 | 7/2017 | Dent et al. |
| 2017/0342797 | A1 | 11/2017 | Murphree et al. |
| 2018/0023366 | A1 | 1/2018 | Deng et al. |
| 2018/0298716 | A1 | 10/2018 | Cayson et al. |
| 2018/0298718 | A1 | 10/2018 | Cayson et al. |
| 2018/0320473 | A1 | 11/2018 | Xu et al. |
| 2019/0017347 | A1 | 1/2019 | Kendall et al. |
| 2019/0078413 | A1 | 3/2019 | Kendall et al. |

FOREIGN PATENT DOCUMENTS

| | | | |
|---|---|---|---|
| WO | 2006046075 | A2 | 5/2006 |
| WO | 2006121340 | A1 | 11/2006 |
| WO | 2009074785 | A2 | 6/2009 |
| WO | 2013128222 | A1 | 9/2013 |

OTHER PUBLICATIONS

Notification of Transmittal of the International Search Report and the Written Opinion of the International Searching Authority, or the Declaration; PCT/US2018/041880; dated Nov. 21, 2018; 13 pages.
Notification of Transmittal of the International Search Report; PCT/US2018/050395; dated Jan. 2, 2019; 5 pages.

SEAL BACKUP, SEAL SYSTEM AND WELLBORE SYSTEM

DOMESTIC PRIORITY

This Application claims the benefit of an earlier filing date from U.S. application Ser. No. 15/486,621 filed Apr. 13, 2017, the entire disclosure of which is incorporated herein by reference.

BACKGROUND

In the resource recovery industry, seals are often used to segregate fluid volumes. In some cases pressure among the fluid volumes can be vastly different thereby requiring the seals used therebetween to hold enormous differentials. Seal elements tend to be constructed from relatively soft materials such as elastomeric materials or soft metals, etc. These conform well to irregularities in a borehole tubular to enhance the seal made thereby but also are subject to extrusion based upon the pressure differentials to which they are subject. To help guard against extrusion, backups have been used. Backups are generally made of tougher and more rigid material that helps reduce the size of extrusion gaps adjacent the element so that a larger pressure differential would be necessary to cause extrusion of the element through the smaller extrusion gap. Such backups have been relatively successful but have not alleviated the need for better solutions that allow for higher differential sealing capacity with further reduced extrusion. In view hereof the art is still receptive to improvements in the area.

SUMMARY

A seal backup including: a ring-like body, the body including: a first portion of the body having a first generally zig-zag construction, the first generally zig-zag construction facilitative of radial expansion of the first portion; a second portion of the body having a second generally zig-zag construction, the second generally zig-zag construction facilitative of radial expansion of the second portion; a parting feature disposed between the first portion of the body and the second portion of the body facilitative of relative movement between the first portion of the body and the second portion of the body.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
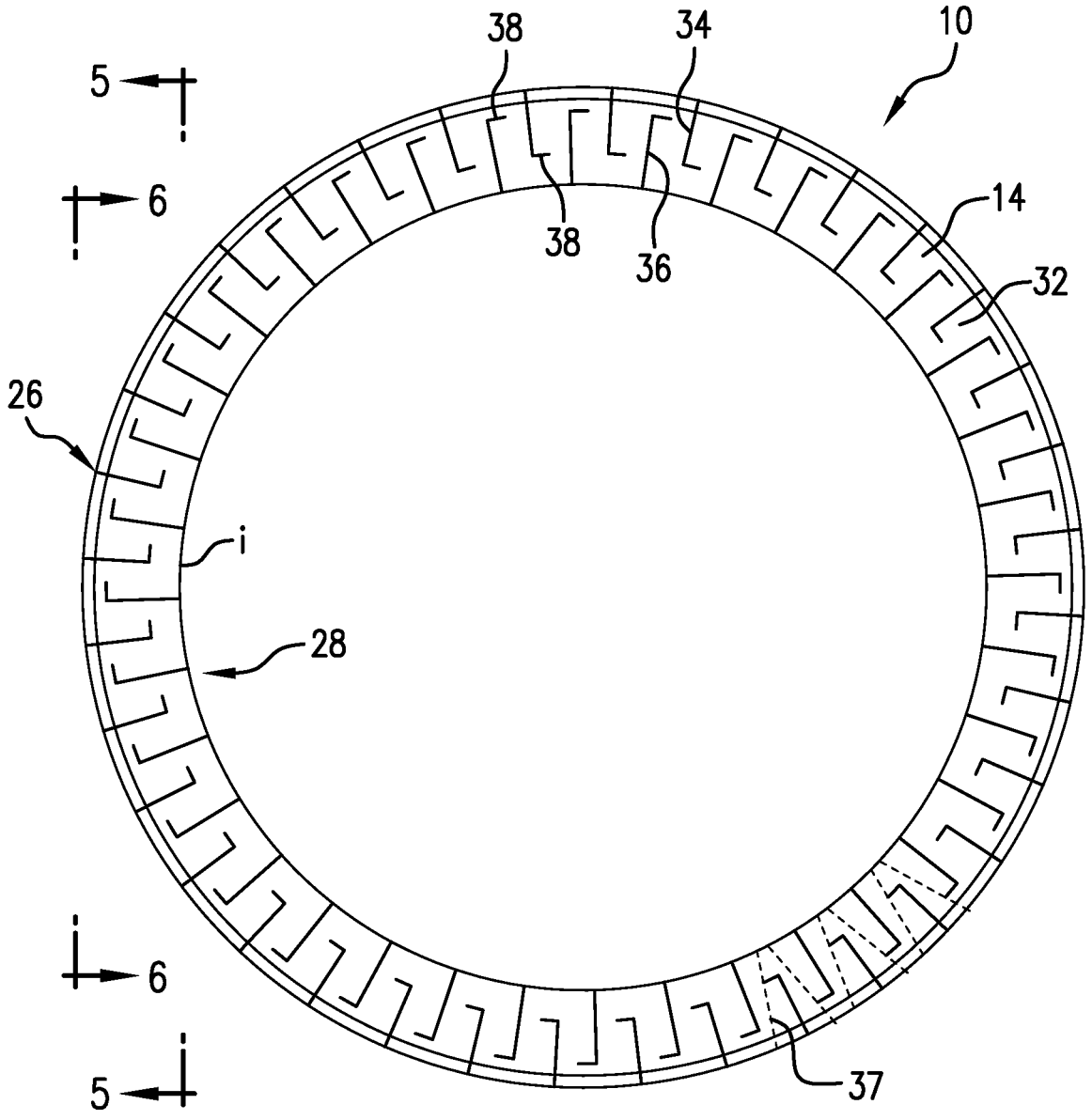
FIG. 1 is a plan view of a seal backup as disclosed herein in a pre-deployed condition.
Figure 2:
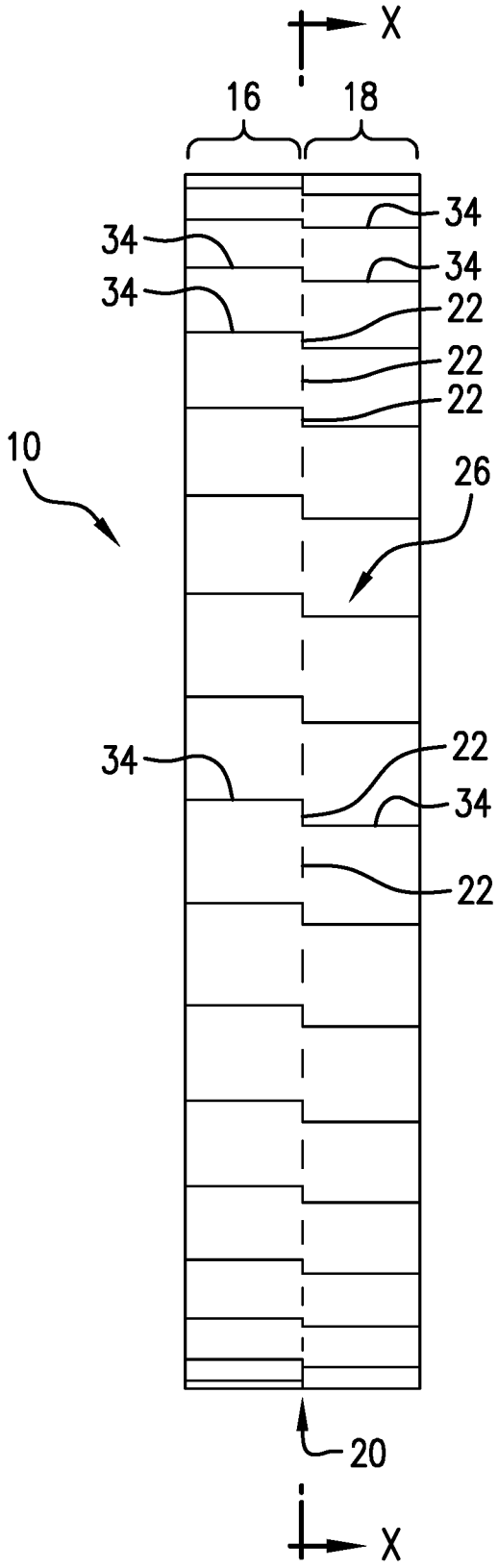
FIG. 2 is a side view of the backup of FIG. 1.
Figure 3:
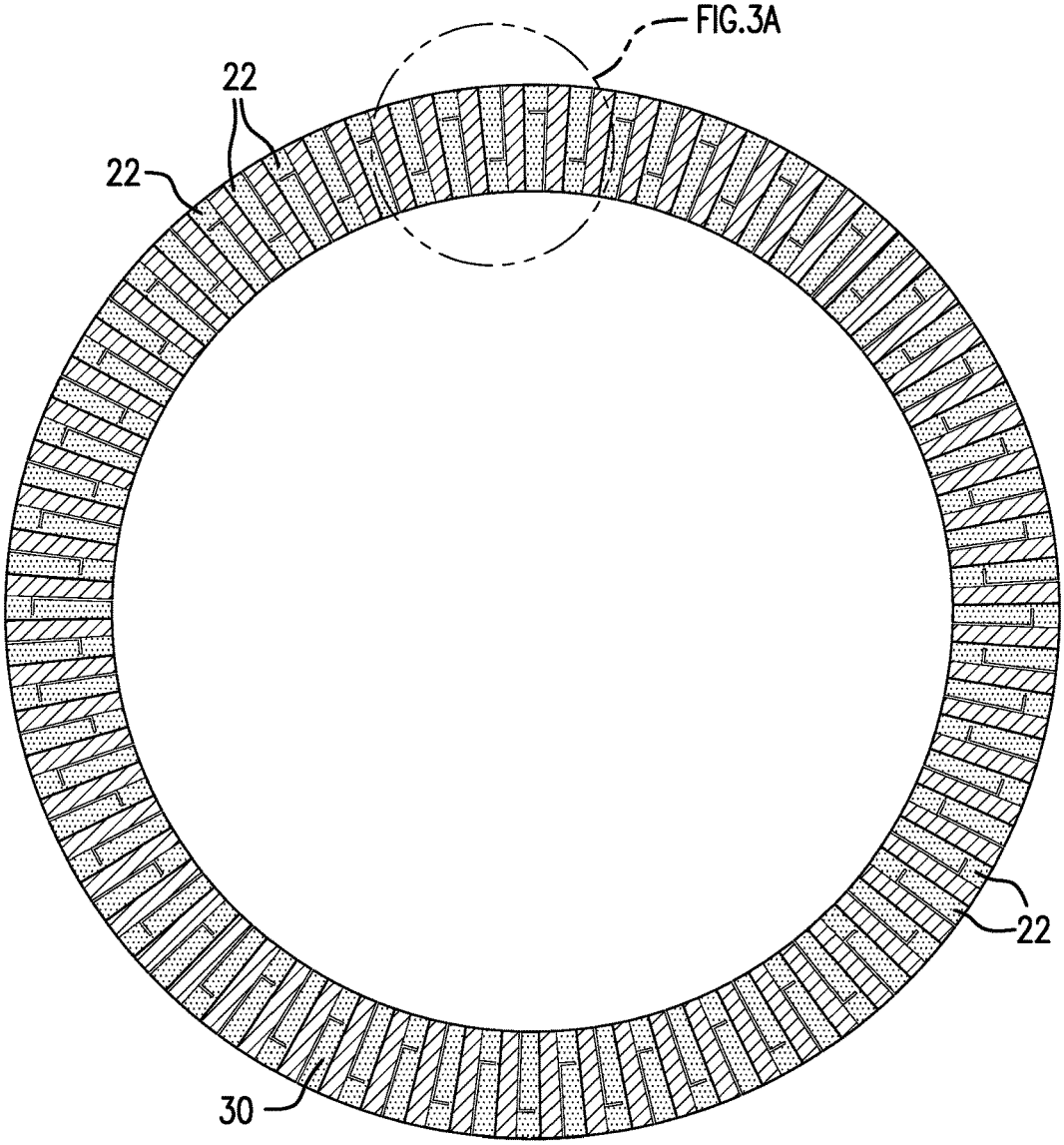
FIG. 3 is a cross sectional view illustrating the parting feature before expansion as disclosed herein.
Figure 3A:
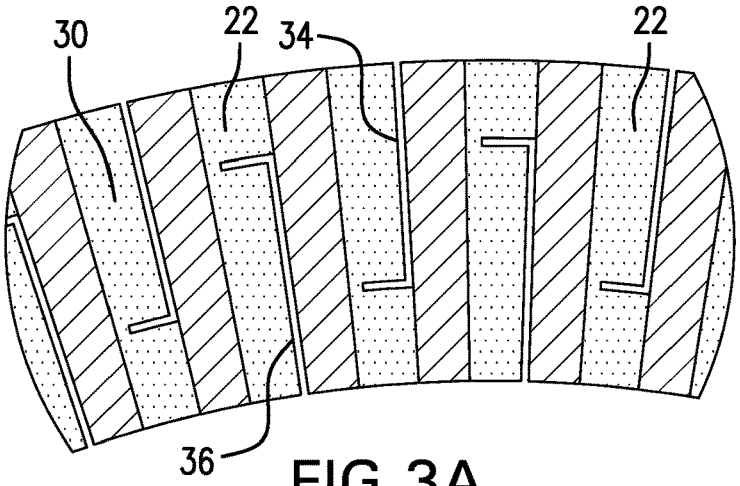
FIG. 3A is an enlarged illustration of a portion of FIG. 3.
Figure 4:
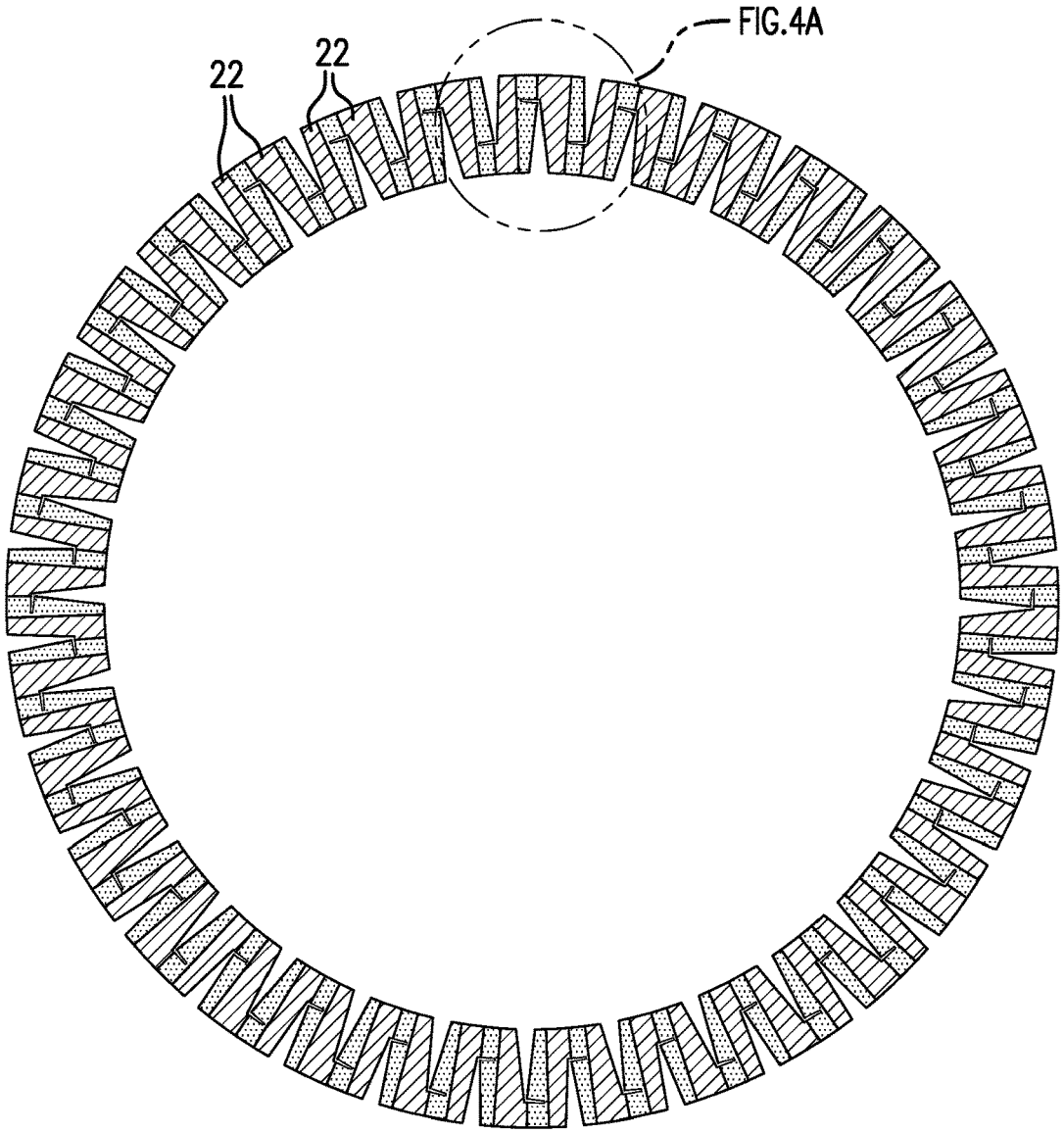
FIG. 4 is a cross sectional view illustrating the parting feature after expansion as disclosed herein.
Figure 4A:
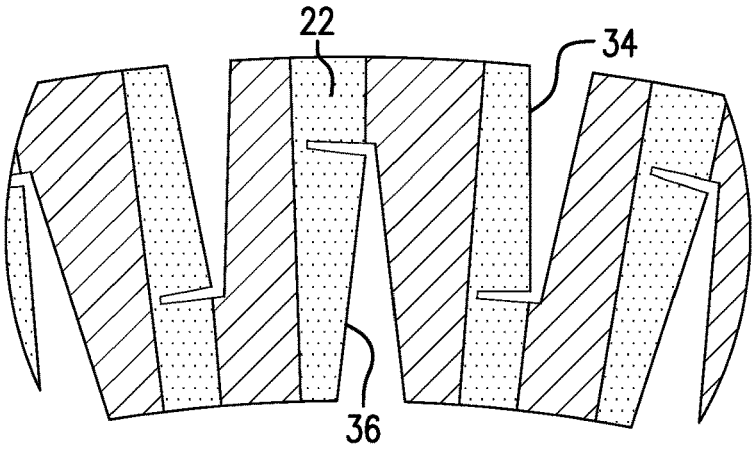
FIG. 4A is an enlarged illustration of a portion of FIG. 3.

Referring to FIGS. 1-6, a seal backup 10 is illustrated in a pre-deployed (initial manufactured, and which may be by additive manufacture) condition. It is to be appreciated that while the illustration uses a circular geometry to represent the backup 10, other geometries such as elliptical or polygonal and even irregular shapes are also contemplated. It is therefore to be appreciated that the term "ring" or "ring-like" as used herein, is meant to encompass circular geometries and other geometries beyond circular such as elliptical or polygonal, or irregular shape, for example. Likewise, the term "perimetrical" as used herein is meant to be understood to be in the same plane in which the term "circumferential" would apply to the backup is circular (as in FIG. 1) but is meant to encompass other geometries as well as circular such as elliptical or polygonal, or irregular shape, for example. By the definition stated herein for the term "perimetrical", the perimetrical shape of an elliptical toroid with circular cross section is an ellipse rather than a circle. FIG. 1 illustrates a plan view while FIG. 2 illustrates a side view so that the two figures taken together along with the view of FIG. 9 (though that view is taken in the deployed condition) provide a good understanding of the overall shape and configuration of the backup 10. The backup 10 comprises a ring-like body 14 that itself comprises two portions, a first portion 16 and a second portion 18. The portions are joined at a parting feature 20 disposed between the first and second portions 16, 18 of body 14. The parting feature 20 is configured as a portion of the body 14 and has the dual function of holding the portions 16 and 18 together while also allowing specific areas 22 of the portions 16 and 18 to shift relative to each other. In embodiments, the shifting areas 22 may experience material shearing and in such embodiments are specifically configured to shear at a selected input, that input being lower than the shear resistance of at least one of portions 16 or 18 since the areas 22 by intent will possess less shear strength than at least one of portions 16 and 18. Alternatively, the areas 22 may represent disconnections between portion 16 and portion 18 to allow for shifting in accordance with the teaching hereof without the need for shearing of material. In an embodiment, the feature 20 comprises a number of areas 22 spaced from each other perimetrically about the body 14. In some iterations, the areas may be arranged as radially directed stripes (see FIGS. 3 and 3A for before expansion condition and FIGS. 4 and 4A for post expansion condition) and may have a lower density due to material change or material construction (to promote shearing). In iterations, the areas 22 may be a honeycomb of material and they, and/or any part of the seal backup 10, may be made in an additive manufacturing process.

The portions 16 and 18 in an embodiment each have a roughly trapezoidal cross sectional shape comprising a radial outside edge 26, a radial inside edge 28, a border 30 with the parting feature 20 and an angular face 32. Since the portions 16 and 18 are actually connected together at the parting feature 20, the surfaces noted extend to both of the portions 16 and 18.

Each of the portions 16 and 18 comprises a ring-like shape that includes a number of slots 34 extending radially inwardly from the radial outside edge 26 and not reaching a radial inside edge 28 and a number of slots 36 that extend radially outwardly from the radial inside edge 28 and not reaching the radial outside edge 26. As is easily appreciated best in FIG. 1, the slots 34 and the slots 36 alternate perimetrically in each of portions 16 and 18 (note that FIG. 1 is illustrative of either portion 16 or portion 18). The number of slots (34 or 36) may be many as illustrated. It is contemplated that as few as eight slots 34 and eight slots 36 may be employed and as many as may be practicable with the space available. The result is a zig-zag in the material of the portions 16 and 18 when viewed as in FIG. 1. In order to ensure the reader sees the zig-zag character of the portions 16 and 18, a dashed line 37 has been added to FIG. 1 to illustrate the point.

Figure 5:
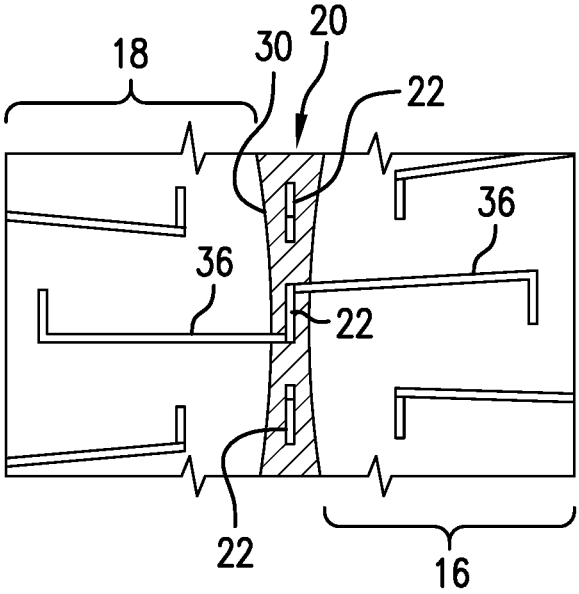
FIG. 5 is a view of the backup illustrated in FIG. 1 taken along section line 5-5.
Figure 6:
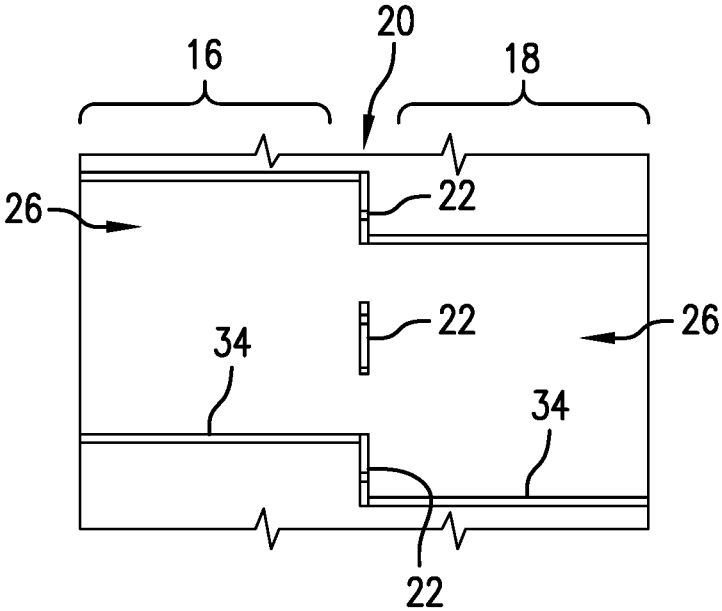
FIG. 6 is a view of the backup illustrated in FIG. 1 taken along section line 6-6.

While portions 16 and 18 are essentially identically laid out to each other, when viewed as body 14, they are rotationally offset by a number of degrees. This is visible in FIG. 2 where slots 34 in portion 16 are seen to be offset from slots 34 in portion 18. It can be seen in FIG. 5 that slots 36 in portion 16 versus portion 18 are also offset from one another. This is important to function in some embodiments. Also notable in the embodiment shown in FIG. 2, is that an area 22 is contiguous with an adjacent slot 34 from portion 16 and an adjacent slot 34 from portion 18. Referring to FIG. 5, similarly, an area 22 is contiguous with an adjacent slot 36 from portion 16 and an adjacent slot 36 from portion 18. Important to appreciate is that the contiguity shown for the slots 34 and the slots 36 are with alternating areas 22. Restated, one area 22 will be contiguous with one set of slots 34 and the next perimetrical area 22 will be contiguous with slots 36. This will alternatingly progress around the perimeter of the backup 10.

Where slots 34 or slots 36 are contiguous with an area 22, upon deployment of the backup and expansion thereof, the slots 34 or slots 36 will open and the contiguous area 22 will slide apart. This is best appreciated in FIGS. 8 and 9 which are discussed further below.

Before addressing the deployed condition directly, it is also noted that in an embodiment, an additional feature is sometimes included. This is an extension 38 that is positioned to intersect the slots 34 or the slots 36 or both (though one extension does not intersect both of a slot 34 and a slot 36 at the same time). In an iteration, the extension 38 will form an "L" shape with the slot 34 or 36 with which it is associated. The extension 38 may be positioned at substantially 90 degrees with its associated slot 34 or 36. By "substantially", it is meant plus or minus 10% of the specified angle and further to encompass machine tolerances. The extension 38 has for its purpose, when employed, to reduce stresses in the material forming the zig-zag of portion 16 or 18 such that less twisting of the material occurs than if the extension is not employed.

Figure 7:
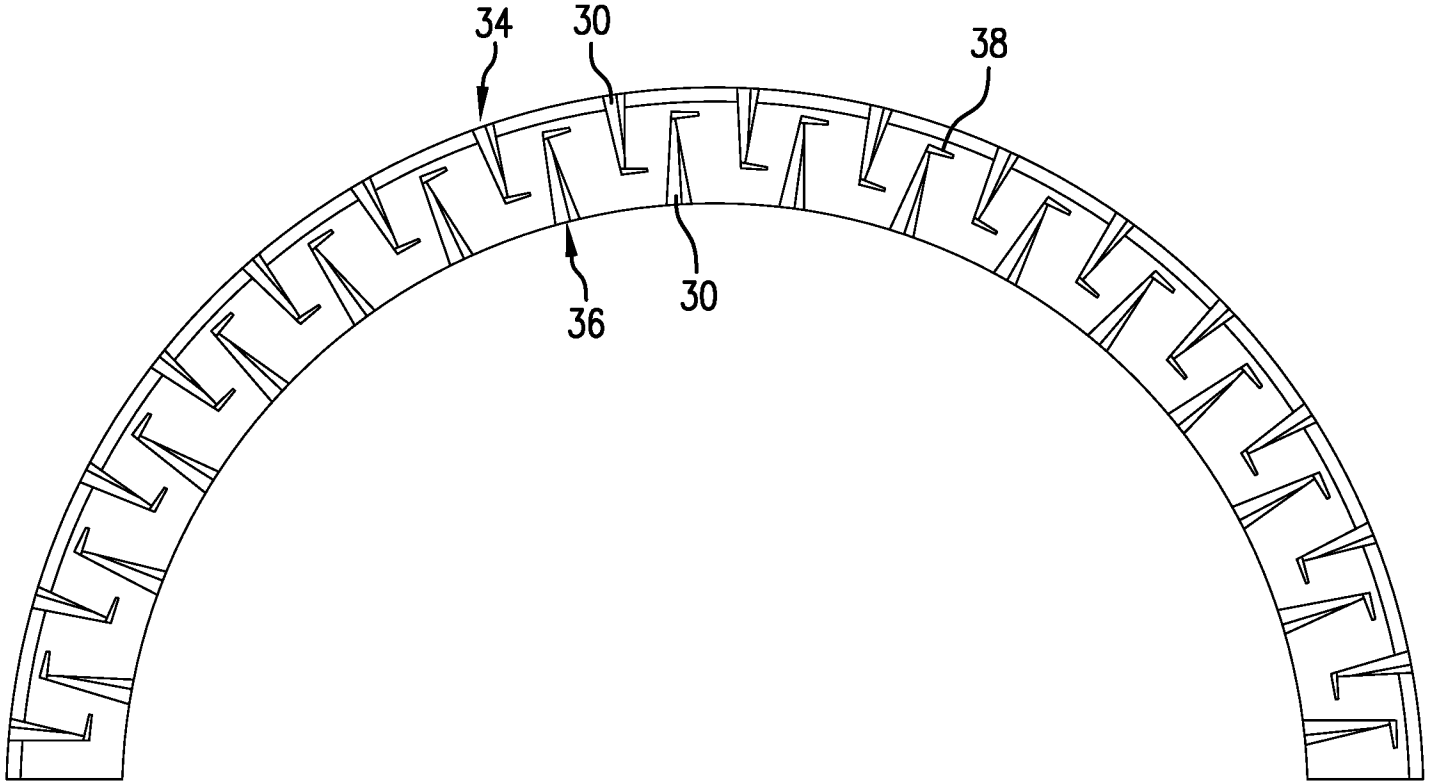
FIG. 7 is a plan view of part of the backup ring of FIG. 1 in a deployed condition.
Figure 8:
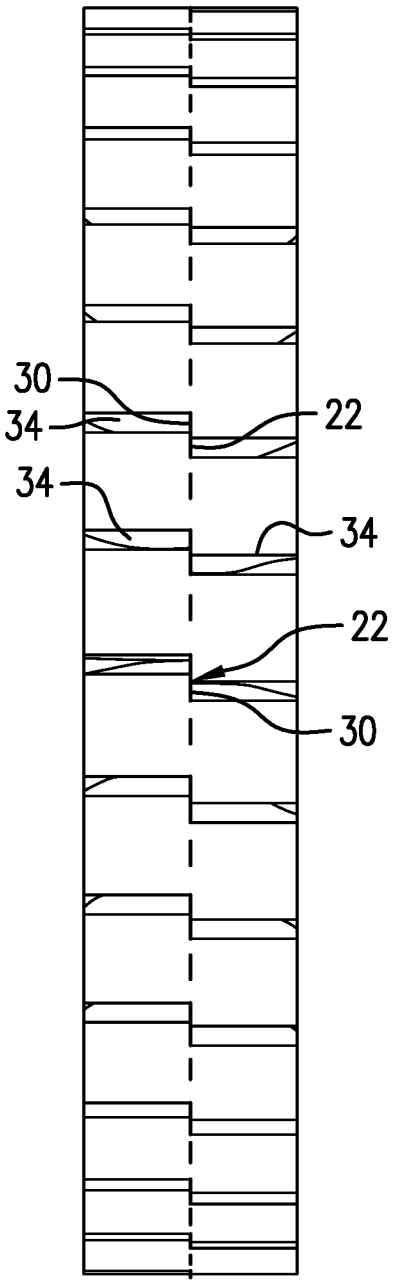
FIG. 8 is a side view of FIG. 7.
Figure 9:
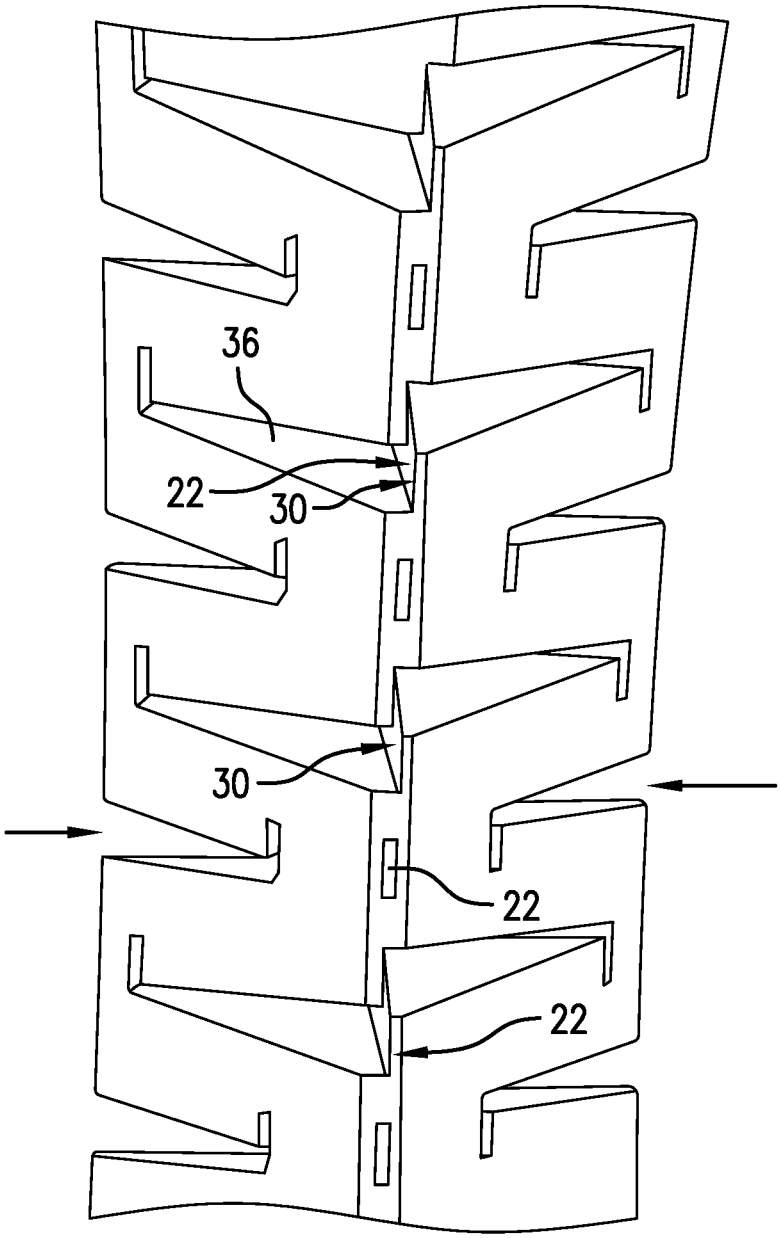
FIG. 9 is a view of the backup ring as disclosed herein from a point inside of the ring looking radially outwardly at the ring in the deployed condition.

Referring now to FIGS. 7, 8, and 9, the seal backup 10 is illustrated in a deployed condition. The deployed condition of the backup 10 is one in which the backup is radially expanded to assume a larger perimetrical set of dimensions. That set of dimensions may be a single dimension for a circular form or more than one dimension if the expanded backup has a different geometrical shape such as an ellipse, polygon, or some irregular shape. In order to allow the expansion of the backup without the introduction of extrusion gaps, i.e. passages through the backup through which a seal element might extrude under pressure, the slots 34 and 36 that create the zig-zag shape of the portions 16 and 18 are allowed to open up which straightens the zig-zag somewhat and causes the perimeter measurement to grow. The offset of the slots 34 in portions 16 and 18 combined with each contiguous area 22 shearing or sliding as described above results in a part of border 30 of portion 16 being disposed in alignment with an open slot 34 of portion 18 and a part of border 30 of portion 18 being aligned with an open slot 34 of portion 16. Likewise the offset of the slots 36 in portions 16 and 18 combined with the area 22 shearing as described above results in a part of border 30 of portion 16 being disposed in alignment with an open slot 36 of portion 18 and a part of border 30 of portion 18 being aligned with an open slot 36 of portion 16. Thereby an open slot 34 or 36 in portion 16 cannot provide an extrusion path for an element adjacent thereto in a seal tool because a border 30 of portion 18 is in the way of both of those potential extrusion paths. Likewise open slot 34 or 36 in portion 18 cannot provide an extrusion path because a border 30 of portion 16 is in the way of both of those potential extrusion paths.

Figure 10:
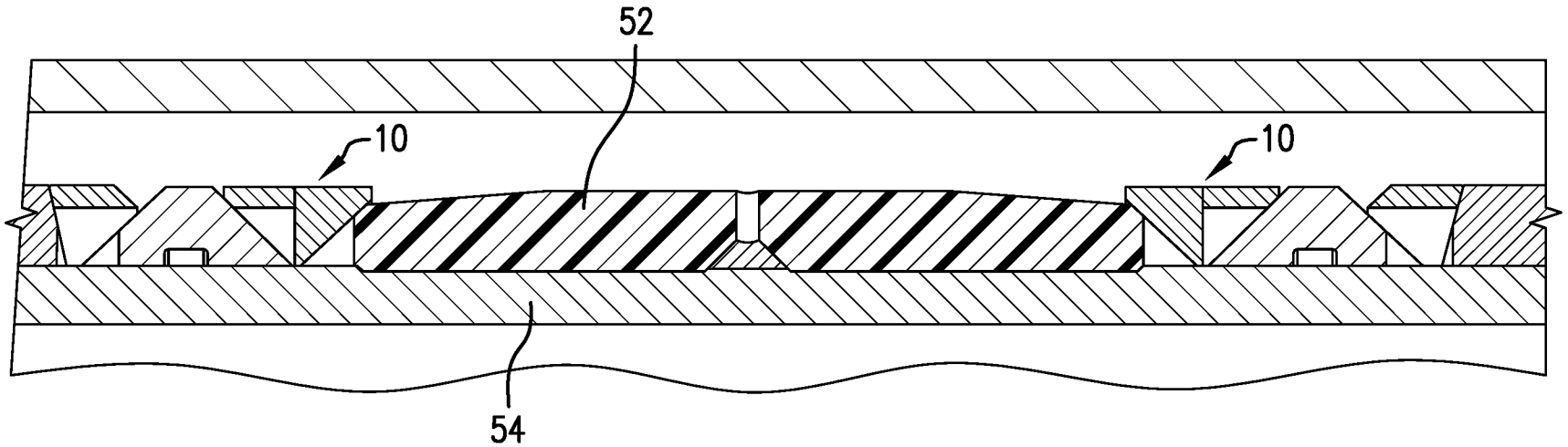
FIG. 10 is a seal tool employing the seal backup as disclosed herein.

FIG. 10 provides an illustration of a seal tool 50 with the seal backup 10 employed therein. The backup 10 is disposed adjacent an element 52 that may be elastic in nature. Both are mounted on a mandrel 54 as will be familiar to those of skill in the art.

Figure 11:
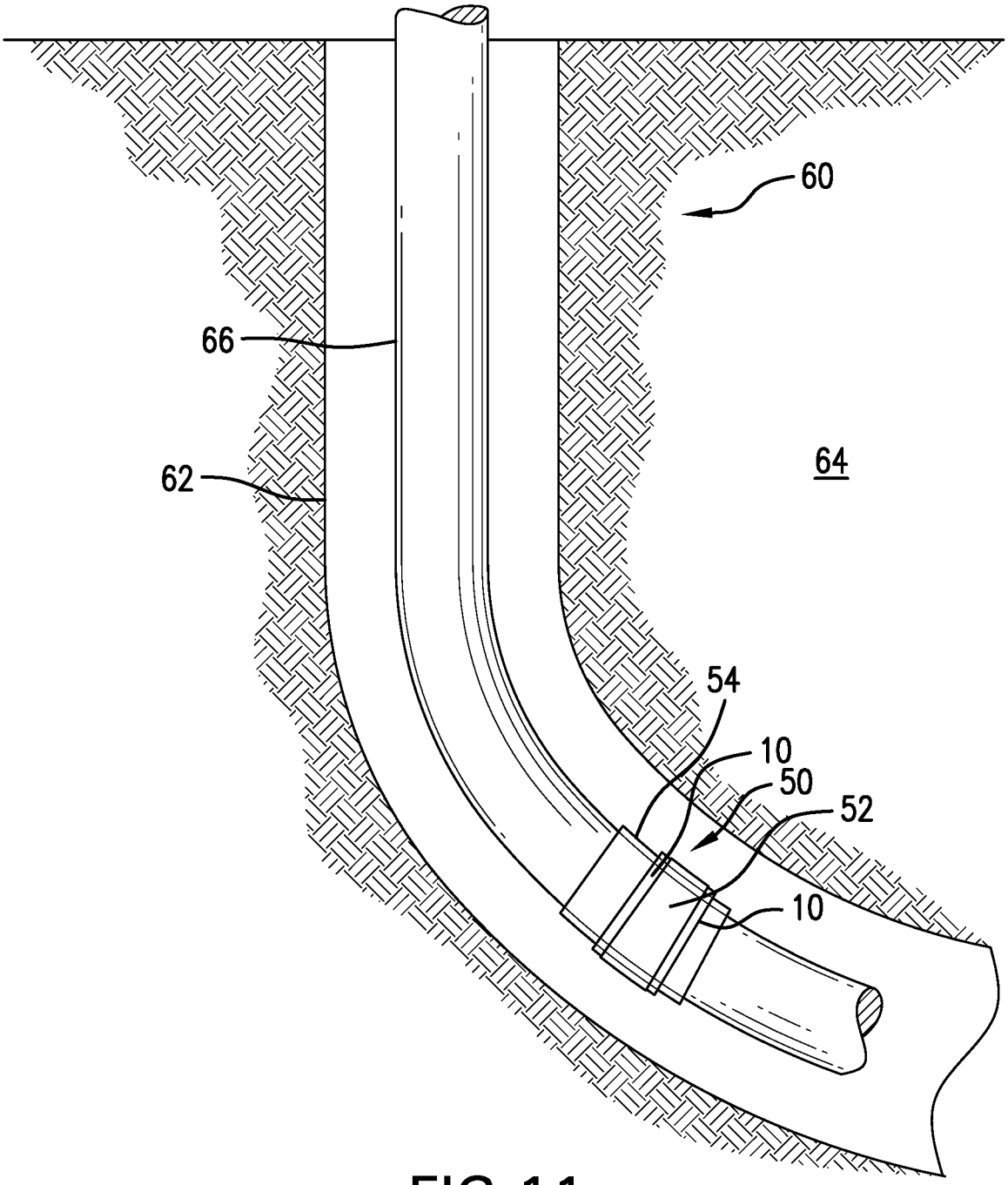
FIG. 11 is a schematic representation of a borehole system with the seal tool and backup as disclosed therein.

Referring to FIG. 11, a borehole system 60 is illustrated having a borehole 62 in a formation 64. A string 66 is disposed within the borehole 62, the string having a seal tool 50 therein.

Set forth below are some embodiments of the foregoing disclosure:

Embodiment 1

A seal backup including: a ring-like body, the body including: a first portion of the body having a first generally zig-zag construction, the first generally zig-zag construction facilitative of radial expansion of the first portion; a second portion of the body having a second generally zig-zag construction, the second generally zig-zag construction facilitative of radial expansion of the second portion; a parting feature disposed between the first portion of the body and the second portion of the body facilitative of relative movement between the first portion of the body and the second portion of the body.

Embodiment 2

The seal backup as in any prior embodiment wherein the generally zig-zag constructions of the first and second portions of the body are formed by slots extending radially outwardly from an inside surface of each of the first and second portions of the body alternating with slots extending radially inwardly from an outside surface of each of the first and second portions of the body.

Embodiment 3

The seal backup as in any prior embodiment wherein slots of the first portion of the body are perimetrically offset from slots of the second portion of the body.

Embodiment 4

The seal backup as in any prior embodiment wherein during expansion of the backup and opening of the slots of the first and second portions of the body, the first portion of the body occludes open slots in the second portion of the body.

Embodiment 5

The seal backup as in any prior embodiment wherein the second portion of the body occludes open slots in the first portion of the body.

Embodiment 6

The seal backup as in any prior embodiment wherein at least one of the slots extending radially outwardly from an inside surface of each of the first and second portions of the body or the slots extending radially inwardly from an outside surface of each of the first and second portions of the body further includes an extension slot.

Embodiment 7

The seal backup as in any prior embodiment wherein the extension slot extends at an angle from a slot with which it is associated at substantially 90 degrees.

Embodiment 8

The seal backup as in any prior embodiment wherein the extension slot forms an "L" shape with the slot with which it is associated.

Embodiment 9

The seal backup as in any prior embodiment wherein the first portion of the body cross sectionally defines a trapezoid.

Embodiment 10

The seal backup as in any prior embodiment wherein the second portion of the body cross sectionally defines a trapezoid.

Embodiment 11

The seal backup as in any prior embodiment wherein the parting feature comprises a construction having a shear strength less than a shear strength of one of the first and second portions of the body.

Embodiment 12

The seal backup as in any prior embodiment wherein the parting feature comprises an area, the area being contiguous with a slot.

Embodiment 13

The seal backup as in any prior embodiment wherein the parting feature is a plurality of areas arranged between the first and second portions of the body, the areas having less shear strength than one of the first and second portions of the body.

Embodiment 14

The seal backup as in any prior embodiment wherein the areas are spaced from each other perimetrically.

Embodiment 15

The seal backup as in any prior embodiment wherein the areas are radially arranged stripes spaced from one another.

Embodiment 16

The seal backup as in any prior embodiment wherein the parting feature comprises a lower density than one of the first and second portions of the body.

Embodiment 17

The seal backup as in any prior embodiment additively manufactured.

Embodiment 18

The seal backup as in any prior embodiment wherein the parting feature includes a honeycomb structure.

Embodiment 19

A wellbore seal system including: a seal element; and a seal backup as in any prior embodiment.

Embodiment 20

A wellbore system including: a borehole; a string in the borehole; a wellbore seal system as in any prior embodiment disposed in the borehole on or in the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal backup comprising:

a ring-like body, the body comprising:

a first portion of the body having a first generally zig-zag construction, the first generally zig-zag construction facilitative of radial expansion of the first portion;

a second portion of the body having a second generally zig-zag construction, the second generally zig-zag construction facilitative of radial expansion of the second portion;

a parting feature disposed between the first portion of the body and the second portion of the body facilitative of relative movement between the first portion of the body and the second portion of the body wherein the generally zig-zag constructions of the first and second portions of the body are formed by slots extending radially outwardly from an inside surface of each of the first and second portions of the body alternating with slots extending radially inwardly from an outside surface of each of the first and second portions of the body.

2. The seal backup as claimed in claim 1 wherein slots of the first portion of the body are perimetrically offset from slots of the second portion of the body.

3. The seal backup as claimed in claim 2 wherein during expansion of the backup and opening of the slots of the first and second portions of the body, the first portion of the body occludes open slots in the second portion of the body.

4. The seal backup as claimed in claim 3 wherein the second portion of the body occludes open slots in the first portion of the body.

5. The seal backup as claimed in claim 1 wherein at least one of the slots extending radially outwardly from an inside surface of each of the first and second portions of the body or the slots extending radially inwardly from an outside surface of each of the first and second portions of the body further includes an extension slot.

6. The seal backup as claimed in claim 5 wherein the extension slot extends at an angle from a slot with which it is associated at substantially 90 degrees.

7. The seal backup as claimed in claim 5 wherein the extension slot forms an "L" shape with the slot with which it is associated.

8. The seal backup as claimed in claim 1 wherein the first portion of the body cross sectionally defines a trapezoid.

9. The seal backup as claimed in claim 8 wherein the second portion of the body cross sectionally defines a trapezoid.

10. The seal backup as claimed in claim 1 wherein the parting feature comprises an area, the area being contiguous with a slot.

11. The seal backup as claimed in claim 1 additively manufactured.

12. The seal backup as claimed in claim 11 wherein the parting feature includes a honeycomb structure.

13. A seal backup comprising:

a ring-like body, the body comprising:

a first portion of the body having a first generally zig-zag construction, the first generally zig-zag construction facilitative of radial expansion of the first portion;

a second portion of the body having a second generally zig-zag construction, the second generally zigzag construction facilitative of radial expansion of the second portion;

a parting feature disposed between the first portion of the body and the second portion of the body facilitative of relative movement between the first portion of the body and the second portion of the body wherein the parting feature comprises a construction having a shear strength less than a shear strength of one of the first and second portions of the body.

14. A seal backup comprising:

a ring-like body, the body comprising:

a first portion of the body having a first generally zig-zag construction, the first generally zig-zag construction facilitative of radial expansion of the first portion;

a second portion of the body having a second generally zig-zag construction, the second generally zig-zag construction facilitative of radial expansion of the second portion;

a parting feature disposed between the first portion of the body and the second portion of the body facilitative of relative movement between the first portion of the body and the second portion of the body wherein the parting feature is a plurality of areas arranged between the first and second portions of the body, the areas having less shear strength than one of the first and second portions of the body.

15. The seal backup as claimed in claim 14 wherein the areas are spaced from each other perimetrically.

16. The seal backup as claimed in claim 14 wherein the areas are radially arranged stripes spaced from one another.

17. A seal backup comprising:

a ring-like body, the body comprising:

a first portion of the body having a first generally zig-zag construction, the first generally zig-zag construction facilitative of radial expansion of the first portion;

a second portion of the body having a second generally zig-zag construction, the second generally zigzag construction facilitative of radial expansion of the second portion;

a parting feature disposed between the first portion of the body and the second portion of the body, facilitative of relative movement between the first portion of the body and the second portion of the body wherein the parting feature comprises a lower density than one of the first and second portions of the body.

18. A wellbore seal system comprising:

a seal element; and a seal backup as claimed in claim 1.

19. A wellbore system comprising:

a borehole;

a string in the borehole;

a wellbore seal system as claimed in claim 18 disposed in the borehole on or in the string.

* * * * *